US009784283B2

(12) United States Patent
Kao

(10) Patent No.: US 9,784,283 B2
(45) Date of Patent: Oct. 10, 2017

(54) DIFFUSER VANES WITH POCKETS FOR SUBMERSIBLE WELL PUMP

(71) Applicant: Baker Hughes Incorporated, Houston, TX (US)

(72) Inventor: Lin Kao, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 636 days.

(21) Appl. No.: 14/298,613

(22) Filed: Jun. 6, 2014

(65) Prior Publication Data

US 2015/0354590 A1 Dec. 10, 2015

(51) Int. Cl.

| | |
|---|---|
| ***F04D 29/44*** | (2006.01) |
| ***F04D 1/06*** | (2006.01) |
| ***F04D 13/10*** | (2006.01) |
| ***F04D 29/041*** | (2006.01) |

(52) U.S. Cl.

CPC ..... *F04D 29/448* (2013.01); *F04D 1/06* (2013.01); *F04D 13/10* (2013.01); *F04D 29/0413* (2013.01)

(58) Field of Classification Search

CPC ... F04D 1/00; F04D 17/00; F04D 1/06; F04D 1/08; F04D 7/02; F04D 7/04; F04D 13/08; F04D 29/448; F04D 29/041; F04D 17/122; F04D 25/0686; F05D 2240/12

USPC ..... 415/211.2

See application file for complete search history.

(56) References Cited

U.S. PATENT DOCUMENTS

| | | | | |
|---|---|---|---|---|
| 3,477,384 | A * | 11/1969 | Hlinka | F04D 1/066 415/199.3 |
| 4,228,753 | A * | 10/1980 | Davis | F04D 27/02 114/67 A |
| 4,431,374 | A * | 2/1984 | Benstein | F04D 29/444 415/169.1 |
| 6,533,546 | B2 * | 3/2003 | Kreitmeier | F01D 25/30 415/211.2 |
| 7,201,252 | B2 * | 4/2007 | Nevill | H04R 1/345 181/151 |
| 7,905,703 | B2 * | 3/2011 | Cruickshank | F04D 17/122 415/199.2 |
| 8,070,426 | B2 | 12/2011 | Brunner et al. | |
| 8,162,600 | B2 | 4/2012 | Brown et al. | |
| 8,556,586 | B2 * | 10/2013 | Williams | F03D 1/065 416/189 |

(Continued)

FOREIGN PATENT DOCUMENTS

GB 1283696 A * 8/1972 ..... F04D 29/44

*Primary Examiner* — Nathaniel Wiehe
*Assistant Examiner* — Brian O Peters
(74) *Attorney, Agent, or Firm* — Bracewell LLP; James E. Bradley

(57) ABSTRACT

A submersible pump assembly has a centrifugal pump with a number of stages, each of the stages having a rotatable impeller and a non rotating diffuser. The diffuser has vanes, each of the vanes curving radially inward from an outer end to an inner end. The vanes define vane passages between adjacent ones of the vanes through which well fluid flows. The vanes have thicknesses between inner and outer sides of each of the vanes that gradually increase from the outer ends toward the inner ends. At least one pocket is formed in each of the inner sides of each of the vanes. The pockets are open cavities to receive a portion of the well fluid flowing from the vane passages to the diffuser outlet.

15 Claims, 5 Drawing Sheets

(56) References Cited

U.S. PATENT DOCUMENTS

| | | | |
|---|---|---|---|
| 2011/0194926 | A1 | 8/2011 | Stair et al. |
| 2011/0255951 | A1 | 10/2011 | Song et al. |
| 2012/0107114 | A1 | 5/2012 | Brunner et al. |
| 2012/0288385 | A1 | 11/2012 | Song |
| 2013/0051977 | A1 | 2/2013 | Song et al. |
| 2013/0101446 | A1 | 4/2013 | Kao et al. |

* cited by examiner

DIFFUSER VANES WITH POCKETS FOR SUBMERSIBLE WELL PUMP

FIELD OF THE DISCLOSURE

This disclosure relates in general to electrical submersible pumps for wells and in particular to a pump stage with a diffuser with vanes having pockets.

BACKGROUND

Electrical submersible pumps (ESP) are widely used to pump hydrocarbon production wells. A typical ESP has a rotary pump driven by an electrical motor. A seal section, normally located between the pump and the motor, reduces a differential between the well fluid pressure on the exterior of the motor and the lubricant pressure within the motor. A drive shaft, normally in several sections, extends from the motor through the seal section and into the pump for rotating the pump.

ESP's often employ centrifugal pumps having a large number of pump stages. Each pump stage has an impeller that is rotated by the shaft. The impeller has vanes that propel the well fluid radially outward. A diffuser has vanes with passages between that receive the well fluid accelerated by the next upstream impeller and deliver the fluid radially inward to the intake of the next downstream impeller.

Typically, the diffuser vanes have thin, constant thickness walls that spiral inward. However, diffuser vanes that progressively thicken from the outer end to the inner end are known.

SUMMARY

A submersible pump assembly has a motor and a centrifugal pump. Each of the stages of the pump has a rotatable impeller and a non rotating diffuser. The diffuser comprises a plurality of vanes curving inward from a peripheral area of the diffuser toward a central outlet of the diffuser. A vane convex surface extends from an outer end to an inner end of each of the vanes. A vane concave surface extends from the outer end to the inner end on a side of the vane opposite the vane convex surface. At least one pocket is formed in the vane concave surface.

The pocket has an open mouth at the vane concave surface for receiving a portion of well fluid flowing between the vanes from the peripheral area to the outlet. The pocket has a closed end outward from the vane concave surface. An outer portion of the closed end is closer to the vane convex surface than to the vane concave surface. In the preferred embodiment, the pocket has a pocket convex surface and a pocket concave surface facing the pocket convex surface. The dosed end is curved and joins the pocket concave surface with the pocket convex surface. In the example shown, a width of the pocket between the pocket concave surface and the pocket convex surface decreases from the mouth in a direction toward the closed end.

A mouth radial line extends from the axis of the diffuser through a midpoint of the mouth. A closed end radial line extends from the axis and through a midpoint of the closed end. The mouth radial line is at an acute angle relative to the closed end radial line in the embodiment shown. The pocket concave surface may have a length less than the vane concave surface.

The vane has a thickness between the vane concave and the vane convex surfaces that increases from the outer end toward the inner end. A vane passage is defined between the vane convex surface of one of the vanes and the vane concave surface of an adjacent one of the vanes, The thickness of the vane measured along any radial line passing through the vane concave surface and the vane convex surface gradually increases from the outer end toward the inner end and is greater than a width of the vane passage at any of the radial lines passing through the vane concave surface and the vane convex surface.

DETAILED DESCRIPTION OF THE DISCLOSURE

Figure 1:
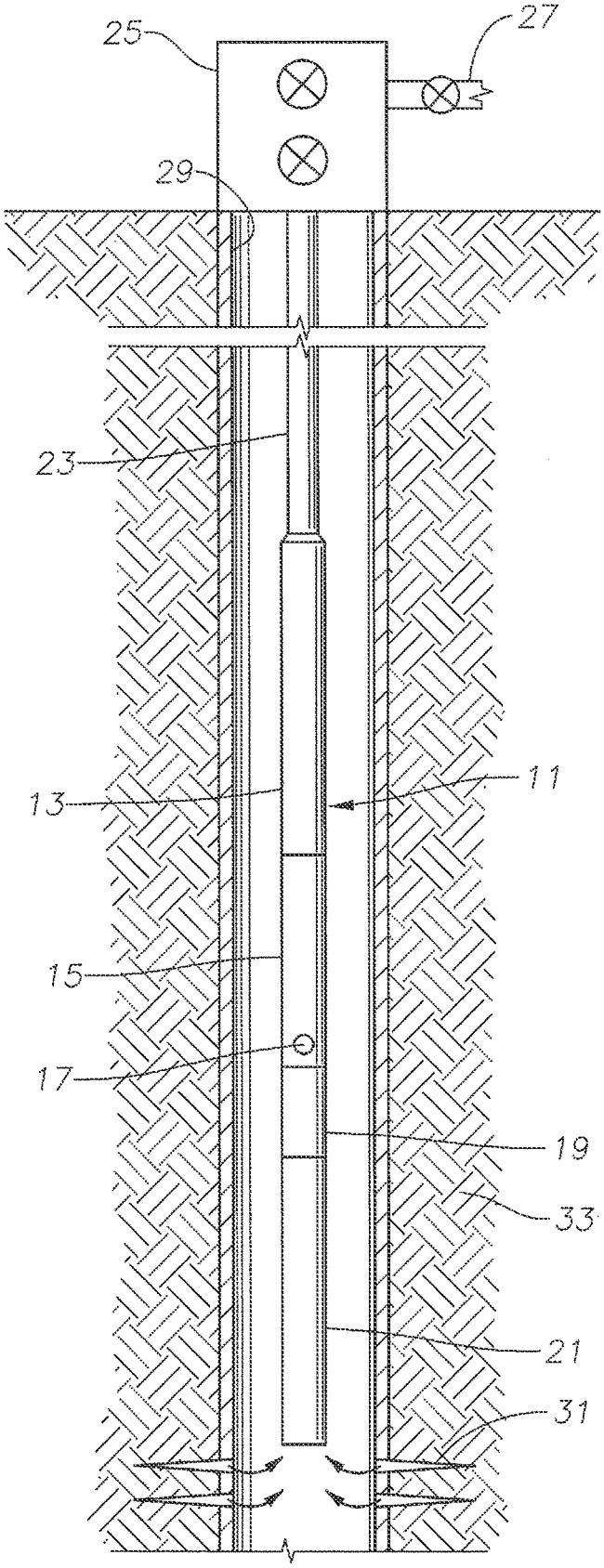
FIG. 1 is a schematic side view of an electrical submersible pump assembly in accordance with this disclosure installed within a well.

Referring to FIG. 1, an electrical submersible pump assembly (ESP) 11 includes a centrifugal pump 13. An optional gas separator 15 secures to the lower end of pump 13 and has an intake 17 for receiving well fluid. If a gas separator is not employed, the intake would he at the lower end of pump 13. An equalizer or seal section 19 connects to the lower end of gas separator 15, if one is employed, and to pump 13 if not. A motor 21 secures to the lower end of seal section 19. Seal section 19 has a device, such as a bag or bellows, that reduces a pressure differential between dielectric lubricant in motor 21, and the well fluid surrounding motor 21. Seal section 19 may include a thrust bearing for handling down thrust generated by pump 13. Optionally, seal section 19 may be mounted below motor 21. Motor 21 preferably comprises a three-phase AC electrical motor.

A string of tubing 23 lands in a wellhead 25 and supports ESP 11. Tubing 23 may comprise threaded joints of tubing secured together or coiled tubing. ESP 11 discharges well fluid through tubing 23 in this example. The well fluid flows through wellhead 25 and out a flow line 27. The well is cased with one or more strings of casing 29. Perforations 31 or other openings admit well fluid from an earth formation 33. Although FIG. 1 illustrates ESP 11 orientated vertically, it could be mounted within inclined and horizontal sections of a well. Consequently, the terms "upper" and "lower" are used herein for convenience only, not in a limiting manner.

Figure 2:
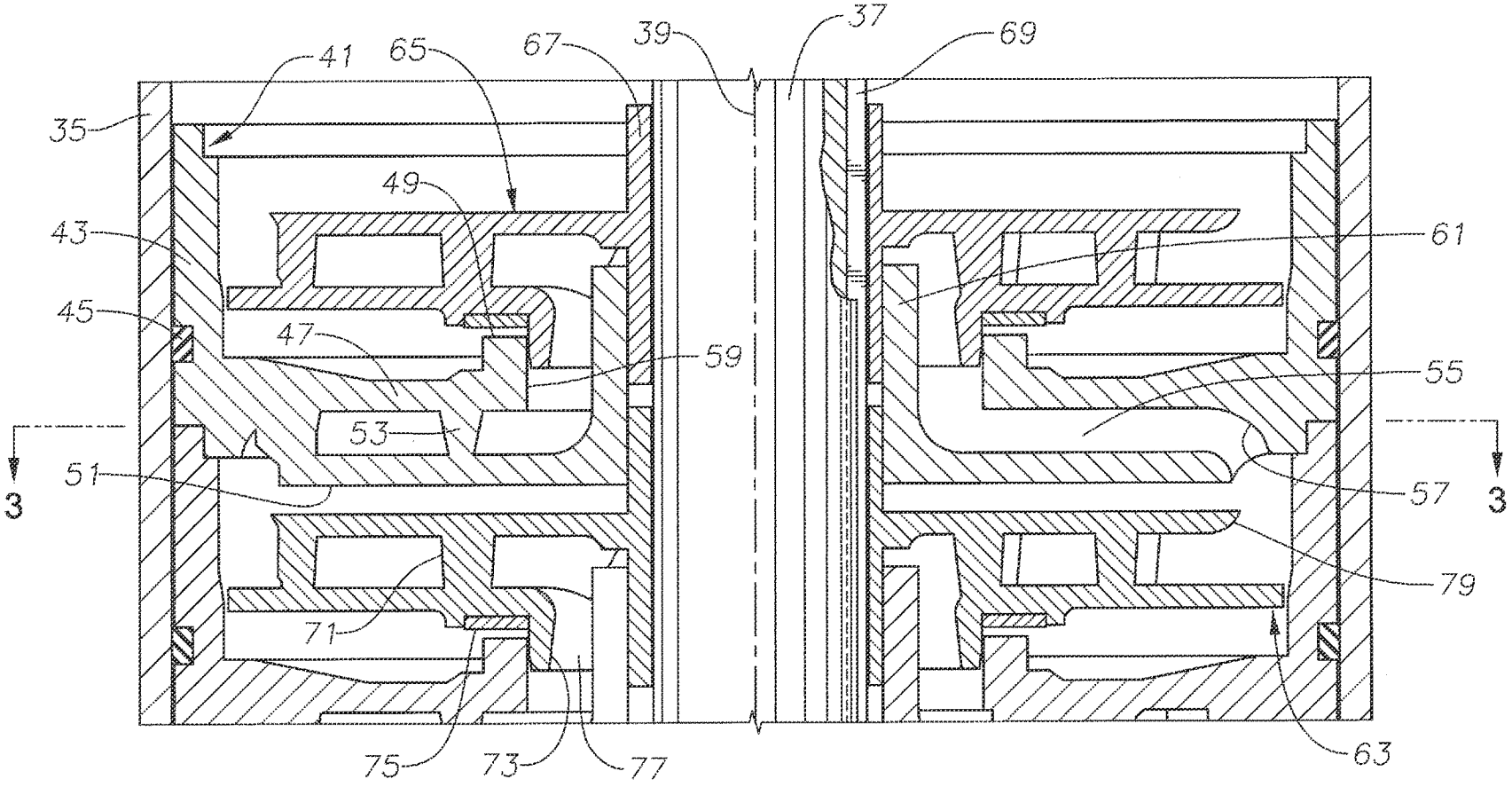
FIG. 2 is a longitudinal sectional view of one of the pump stages of the pump assembly of FIG. 1.

Referring to FIG. 2, pump 13 has a tubular housing 35 that has a longitudinal axis 39. A drive shall 37 rotated by motor 21 (FIG. 1) extends through housing 35 along axis 39. Drive shaft 37 will normally be made up several sections, each having a splined end coupled to an adjacent section. Pump 13 has many stages, each stage including a diffuser 41.

Diffuser 41 has a cylindrical outer wall 43, which has an outer diameter and an inner diameter. A seal 45 on the outer diameter seals diffuser 41 to the inner diameter of pump housing 35. The outer walls 43 of diffusers 41 (only one shown) stack on top of each other within pump housing 35 and are prevented from rotation relative to pump housing 35 by various conventional means.

Diffuser 41 has an upper shroud 47, which in the case of a radial flow type, is a generally planar plate extending radially inward from a lower portion of diffuser outer all 43. An annular upward-facing thrust bearing surface 49 is located at an inner diameter of upper shroud 47. A lower shroud 51 is spaced axially below upper shroud 47 and extends radially inward in a plane parallel with upper shroud 47.

Diffuser vanes 53 are located between upper shroud 47 and lower shroud 51. Normally, diffuser vanes 53 have an upper edge that joins upper shroud 47 and a lower edge that joins lower shroud 51, forming an integral non-moving structure. Adjacent diffuser vanes 53 define flow passages 55 between them. Each flow passage 55 is closed on an upper side by upper shroud 47 and closed on a lower side by lower shroud 51. In this example, each flow passage 55 has a separate inlet 57 located at a peripheral area of diffuser 41. Each flow passage 55 curves in a spiral radially inward from inlet 57 toward a central, axial outlet aperture 59 in upper shroud 47. Diffuser 41 may have a hub 61, which is a concentric cylindrical member extending upward from lower shroud 51 to a point above upper shroud 47. An annular space between hub 61 and outlet aperture 59 serves as a common fluid outlet for diffuser 41.

An upstream or lower impeller 63 and an identical downstream or upper impeller 65 are illustrated in FIG. 2. Each impeller 63, 65 has an impeller hub 67 that is a cylindrical member receiving drive shaft 37. A key 69 engages mating slots to transfer rotation of drive shaft 37 to impellers 63, 65.

Impellers 63. 65 may be conventional and are shown as radial flow types, although they, along with diffuser 41, could be mixed flow types. With a mixed flow type, the fluid is directed outward and upward by impellers 63, 65 and inward and upward by diffusers 41. Each impeller 63, 65 has a plurality of vanes 71 that curve radially outward. Each impeller 63, 65 has a cylindrical skirt 73 extending downward. Skirt 73 of upper impeller 65 fits slidingly within diffuser outlet aperture 59. Skirt 73 of lower impeller 63 fits in the outlet aperture of the next lower diffuser (not shown). A down thrust washer 75 may be mounted to a lower side of each impeller 63, 65 for slidingly engaging one of the thrust surfaces 49 during down thrust. Each impeller 63, 65 has an intake 77, which is an annular opening between skirt 73 and diffuser hub 61. Each impeller 63, 65 has a plurality of outlets 79, each being the outer end of one of the impeller vans passages between impeller vanes 71. After flowing out impeller outlets 79, the fluid moves into diffuser inlets 57 of the next downstream diffuser 41. The fluid flows inward along diffuser vane passages 55 to diffuser outlet aperture 59.

Figure 3:
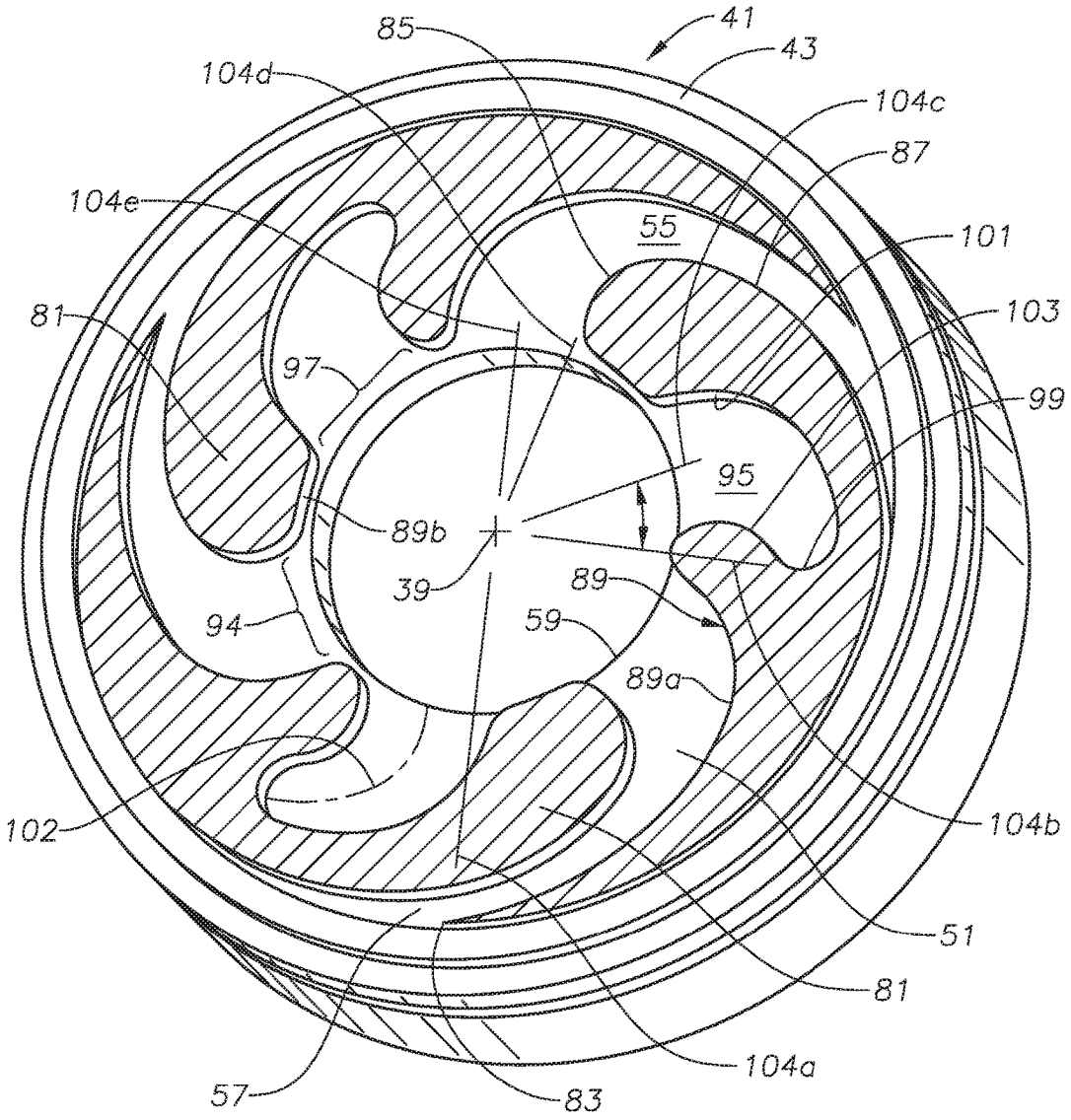
FIG. 3 is a top perspective view of the diffuser of the pump stage of FIG. 2, partially sectioned in a transverse plane to illustrate the vanes.

Referring to FIG. 3, diffuser vanes 81 are shown in section, but diffuser outer wall 43 in perspective. In this example, there are three diffuser vanes 81, but that number can vary. Also, normally, there will be more impeller vanes 71 (FIG. 2) than diffuser vanes 81. Each diffuser vane 81 is identical to the other diffuser vanes 81 and comprises a curved wall extending between lower shroud 51 and upper shroud 47 (FIG. 2). Each diffuser vane 81 spirals inward from a peripheral area of diffuser 41 to the proximity of diffuser outlet aperture 59. An outer end or tip 83 of each diffuser vane 81 is located at the outer peripheral area of diffuser 41, and an inner end 85 of each diffuser vane 81 is close to outlet aperture 59.

Each diffuser vane 81 has an outer or convex side 87 facing generally outward from axis 39 and an inner or concave side 89 facing generally inward toward axis 39. The terms "convex" and "concave" are not used herein to literally refer to a portion of a sphere; rather they refer to an outside portion of a curved structure and an inside portion of a curve structure. In this example, the curvature of outer side 87 is not formed about a single center point; similarly, the curvature of inner side 89 is not formed about a single center point. Further, the curvatures of outer side 87 and inner side 89 differ from each other, rather than being :parallel to each other. Outer side 87 is continuous and uninterrupted from vane outer end 83 to vane inner end 85, inner side 89 has an upstream portion 89*a* curving inward from vane outer end 83. A downstream portion 89*b* joins upstream portion 89*a* and extends to vane inner end 85 at a completely different curvature than upstream portion 89*a*.

Diffuser flow passage 55 extends between the outer side 87 of one diffuser vane 81 and the inner side 89 of the next or adjacent diffuser vane 81. Each diffuser flow passage 55 extends from inlet 57 to an outlet 94 adjacent diffuser outlet aperture 59.

A recess or pocket 95 is formed in inner side 89 of diffuser vane 41. Pocket 95 is a cavity within vane 41 that extends outward from vane inner side portion 89*b*, and it may have different shapes. In this embodiment, each pocket 95 has a mouth 97 located at vane inner side portion 89*b*. Each pocket 95 has a closed end 99 that may have an outer portion closer to vane outer side 87 than vane inner side 89. Each pocket 95 has a concave curved surface 101 that extends from one side of mouth 97 to an outer side of closed end 99. Each pocket 95 has a convex curved surface 103 that faces concave surface 101 and extends from the other side of mouth 97 to the inner side of closed end 99. A center line 102, of pocket 95 equidistant between sides 101, 103 from closed end 99 to mouth 97 curves in the same general manner as vane flow passages 55. Pockets 95 are open for receiving some of the well fluid flowing from flow passages 55 to outlet aperture 59.

Pocket 95 is elongated with a length along center line 102 much greater than the greatest width, which is at mouth 97. Convex surface 103 need not be at the same curvature as concave surface 101. Mouth 97 is illustrated as having a greater width than closed end 99, thus the width of pocket 95 decreases from mouth 97 to closed end 99 in this example. Pocket concave surface 101 has a greater length from mouth 97 to closed end 99 than pocket convex surface 103 in this example. Pocket concave surface 101 has a shorter length and different curvature than vane inner side 89 in this example. Pocket convex surface 103 has a shorter length and different curvature than vane outer side 87 in this example.

The contours of vanes 81 and pockets 95 may vary. However, to more clearly describe the embodiment of FIG. 3, a radial line 104*a* is illustrated as passing through the outer end 83 of one of the vanes 81. A radial line 104*b* passes through the end of vane inner side upstream portion 89*a*. Radial line 104*b* also is approximately tangent to pocket closed end 99. A radial line 104*c* passes through pocket center line 102 at pocket mouth 97. A radial line 104*d* is tangent to vane inner end 85. A radial line 104*e* passes through the center point of vane passage outlet 94. The angular distance from radial line 104*a* to radial line 1 04*d* is about 160 degees, thus providing an example: of an arcuate length of vane 81. The angular distance from radial line 104*a* to radial line 104*b* is about 85 degrees in this embodiment. The angular distance from radial line 104*b* to radial line 104*d* is roughly 70 degrees. Thus vane inner side upstream portion 89*a* extends about 85 degrees and downstream portion 89*b* about 70 degrees, excluding pocket 95. The downstream portion 89*b* from the edge of pocket 95 to vane inner end 85 has a radius formed about a center point coinciding with axis 39.

The width of pocket mouth 97 is approximately the same as the width of vane flow passage outlet 94. Pocket closed end 99 is spaced angularly from center line 102 at pocket mouth 97 by the angular distance between radial lines 104*b* and 104*c*, which is an acute angle of about 30 degrees.

The thickness of each diffuser vane 81 gradually increases from outer end 83 in a direction toward inner end 85. The vane thickness may be measured at any point along any radial line between vane outer side 87 and vane inner side 89. The thickness progressively increases from vane outer end 83 to radial line 104*b*, which is where pocket 95 begins. From radial line 104*b* to radial line 104*d*, the vane thickness would be roughly constant, except for pocket 95.

The width of each diffuser flow passage 55 gradually increases from vane passage inlet 57 to vane passage outlet 94. The width of flow passage 55 may be measured at any point by a line normal to the curved centerline extending along flow passage 55 equidistant between vane outer side 87 and vane inner side 89. The thickness of vane 81 at inner end 85 measured along radial line 104*d* and radial line 104*b* is greater than the width of flow passage 55 measured along the same radial lines.

Figure 4:
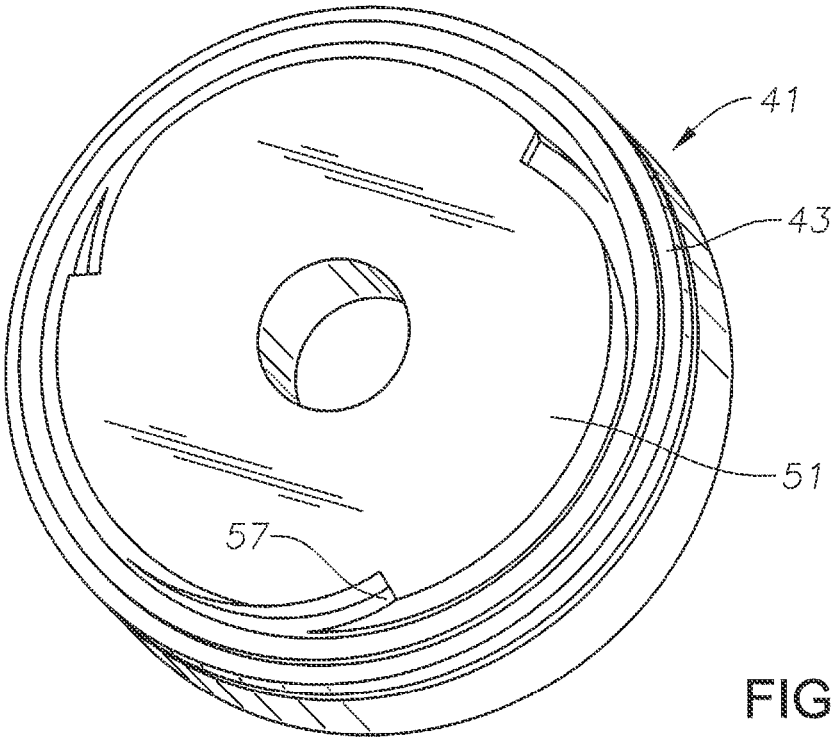
FIG. 4 is a bottom perspective view of the diffuser of FIG. 2.
Figure 5:
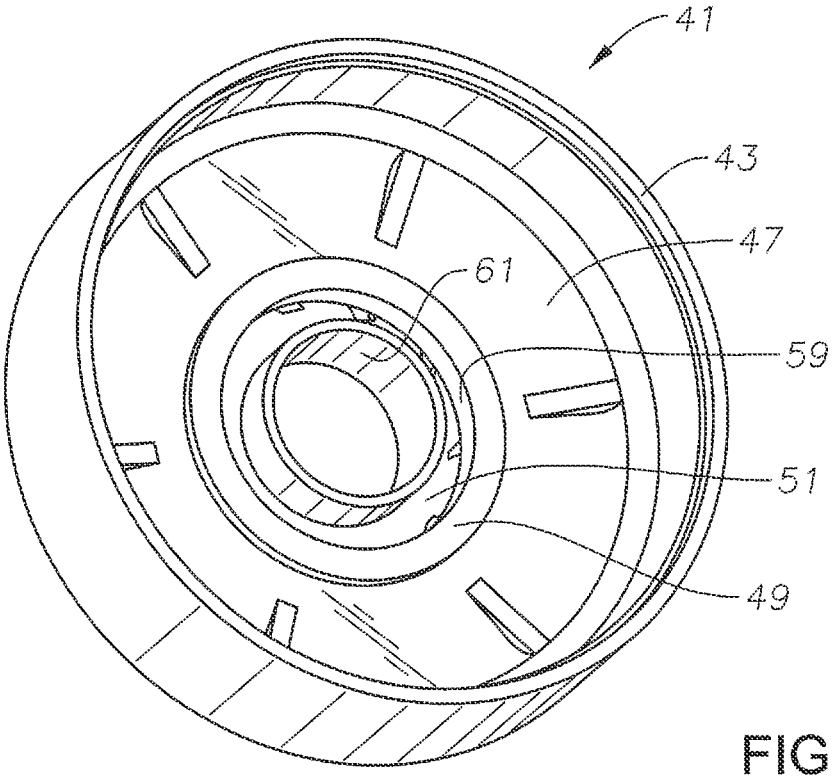
FIG. 5 is a top perspective view of the diffuser of FIG. 2, with the impeller not shown.

FIG. 4 shows the lower side of diffuser lower shroud 51, illustrating each inlet 57 for vane flow passages 55 (FIG. 3). As there are three flow passages 55 in this example, inlets 57 are spaced about 120 degrees apart from each other. FIG. 5 shows the upper side of diffuser upper shroud 47, with upper impeller 65 removed.

Figure 6:
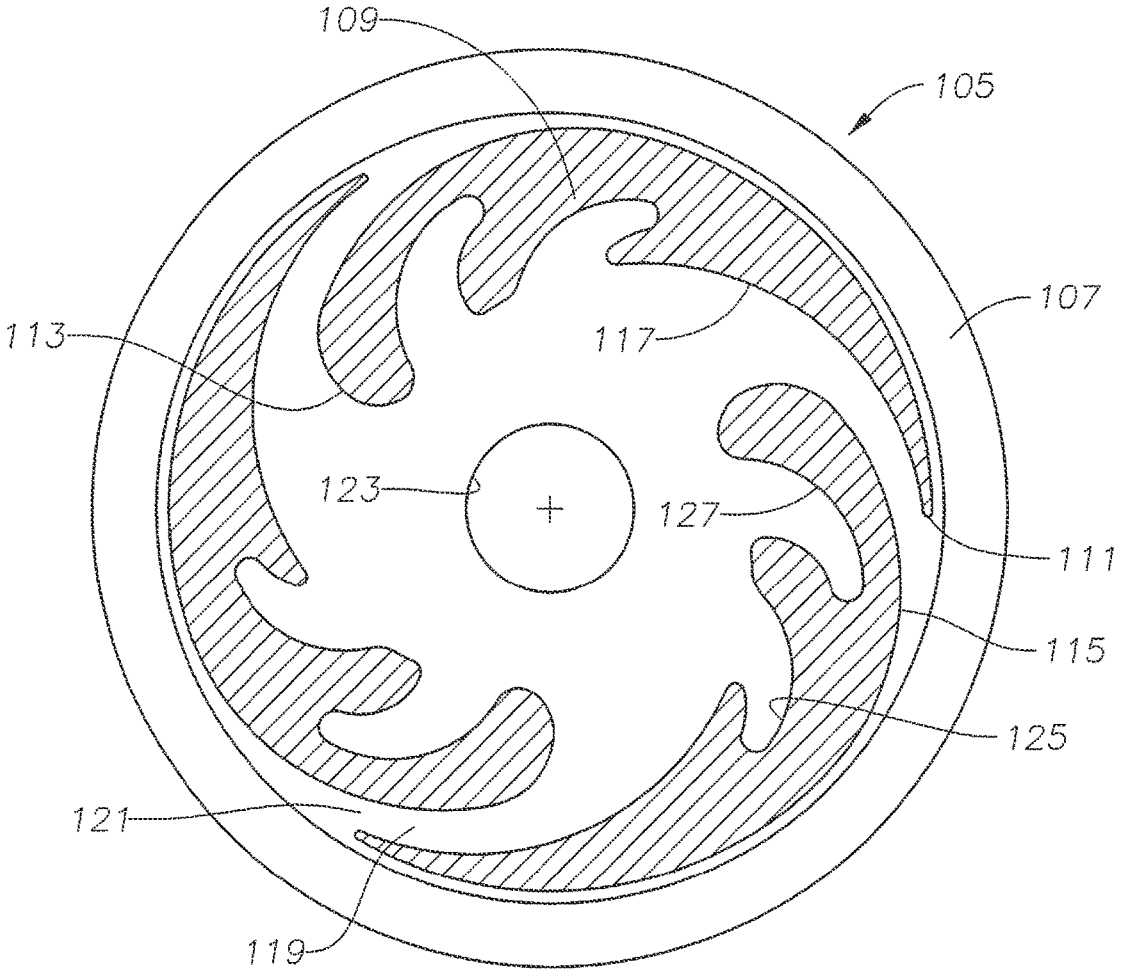
FIG. 6 is a transverse sectional view of an alternate embodiment of a diffuser.

FIG. 6 shows an alternate embodiment of a diffuser 105. Diffuser 105 has a cylindrical outer wall 107. The upper shroud is not shown so as to illustrate diffuser vanes 109. Each diffuser vane 109 has an outlet end 111 and an inner end 113. Each diffuser vane 109 has an outer or convex side 115 and an inner or concave side 117. A flow passage 119 extends between outer side 1.15 of one diffuser vane 109 and inner side 117 of the adjacent diffuser vane 109. Each flow passage has an outer inlet 121 and an inner outlet 123.

In this embodiment, two pockets 125, 127 are formed in the inner side 117 of each vane 109, rather than one as in the first embodiment. Each pocket 125, 1.27 has the same configuration as the single pocket 95 of FIG. 3.

Studies have indicated that the pockets improve the efficiency of the pump. While rotating at the same speed, a higher discharge pressure and efficiency are achieved of a pump constructed as disclosed over a prior art pump.

While the disclosure has been shown in only two of its forms, it should be apparent to those skilled in the art that it is not so limited but is susceptible to various changes without departing from the scope of the disclosure.

The invention claimed is:

1. A submersible pump assembly, comprising:

a motor;

a centrifugal pump operatively connected to the motor and having a longitudinal axis, the pump comprising:

a plurality of stages, each of the stages having a rotatable impeller and a non rotating diffuser, each diffuser comprising:

a plurality of vanes curving inward from a peripheral area toward a central outlet, each of the vanes having an outer end, an inner end, each outer end being farther from the axis than each inner end, and comprising:

a vane curved convex surface extending from each outer end to each inner end;

a vane curved concave surface extending from each outer end to each inner end, each vane curved concave surface being opposite each vane curved convex surface;

at least one pocket formed in each vane curved concave surface;

each pocket having an open mouth at each vane curved concave surface for receiving a portion of a fluid flowing between the vanes from the peripheral area to the central outlet;

each pocket having a pocket curved convex surface and a pocket curved concave surface facing the pocket convex surface;

each pocket having a curved dosed end joining the pocket concave surface with the pocket convex surface; wherein each curved dosed end is closer to the peripheral area than to the inner end of each vane; and each pocket being a dosed chamber but for the open mouth.

2. The assembly according to claim 1, wherein: a width of each pocket between the pocket curved concave surface and the pocket curved convex surface decreases from the mouth in a direction toward the closed end.

3. The assembly according to claim 1, wherein: a mouth radial line extends from the axis through a midpoint of the mouth; a closed end radial line extends from the axis and through a midpoint of each closed end; and the mouth radial line is at an acute angle relative to the dosed end radial line.

4. The assembly according to claim 1, wherein the at least one pocket comprises a plurality of pockets formed in the vane curved concave surface of each of vane.

5. The assembly according to claim 1, wherein the pocket curved concave surface has a length less than the vane curved concave surface.

6. The assembly according to claim 1, wherein each vane has a width between the vane curved concave and the vane curved convex surfaces that increases from the outer end toward the inner end, and the outer end has a greater width than the inner end.

7. The assembly according to claim 1, wherein; a vane passage is defined between the vane convex surface of one of the vanes and the vane concave surface of an adjacent one of the vanes; and a width of the between the vane curved concave surface and the vane curved convex surface at the inner end is greater than a width of the vane passage at the inner end.

8. A submersible pump assembly, comprising:

a motor;

a centrifugal pump operatively connected to the motor and having a longitudinal axis, the pump comprising:

a plurality of stages, each of the stages having a rotatable impeller and a non rotating diffuser, the diffuser of each of the stages comprising:

a plurality of vanes, each of the vanes curving radially inward from an outer end to an inner end;

the vanes defining vane passages between adjacent ones of the vanes through which a fluid flows;

each of the vanes having a width between an inner and an outer side of each of the vanes, each of the vanes width gradually increases from the outer end toward the inner end of each of the vanes;

at least one pocket formed in the inner side of each of the vanes, wherein:

each of the at least one pocket has an open mouth at the inner side of one of the vanes for receiving some of the well fluid flowing out the vane passages;

each of the at least one pocket has a pocket convex surface and a pocket concave surface facing the pocket convex surface;

each of the at least one pocket has a curved closed end joining the pocket concave surface with the pocket convex surface; and a length of the pocket convex surface from the curved closed end to the mouth of each of the at least one pocket is less than a length of the pocket concave surface from the curved closed end to the mouth of each pocket.

9. The assembly according to claim 8, wherein: the closed end of each of the pockets is closer to the peripheral area than the inner end in which the pocket is located.

10. The assembly according to claim 8, wherein each of the at least one pocket in the inner side comprises a plurality of pockets formed in the inner side of each of the vanes.

11. The assembly according to claim 8, wherein: the width of each vane measured between the outer side and the inner side at the inner end of each vane is greater than a width of each vane passage measured at the inner end of each vane.

12. A submersible pump assembly, comprising:

a motor;

a centrifugal pump operatively connected to the motor and having a longitudinal axis, the pump comprising:

a plurality of stages, each of the stages having a rotatable impeller and a non rotating diffuser, the diffuser of each of the stages having an outer diameter, a central outlet, and comprising:

a plurality of vanes, each of the vanes curving radially inward from an outer end at the outer diameter of the diffuser to an inner end adjacent the outlet;

the vanes defining vane passages between adjacent ones of the vanes through which well fluid flows from the outer diameter to the outlet;

the vane passages having widths that along at least part of their lengths progressively increase in a direction toward the outlet; and at least one pocket formed in an inner side of each of the vanes, each of the pockets having an open mouth facing the outlet and a closed end, the closed end having an outer portion closer to an outer side than the inner side of the vane in which the pocket is located.

13. The assembly according to claim 12, wherein each of the pockets has a convex surface and a concave surface extending outward from the mouth and joined by the closed end.

14. The assembly according to claim 12, wherein:

each of the pockets has a convex surface and a concave surface extending outward from the mouth and joined by the closed end; and the convex surface has a shorter length than the concave surface.

15. The assembly according to claim 12, wherein said at least one pocket comprises a plurality of pockets formed in each of the vanes.

* * * * *